US005184411A

United States Patent [19]

Corletto

[11] Patent Number: 5,184,411

[45] Date of Patent: Feb. 9, 1993

[54] INNERBOOT WITH IMPROVED FIT

[76] Inventor: Cesare Corletto, Via Monte Piana 12, 31033 Castelfranco Veneto (Prov. of Treviso), Italy

[21] Appl. No.: 724,034

[22] Filed: Jul. 1, 1991

[30] Foreign Application Priority Data

Jul. 10, 1990 [IT] Italy ..... 82600 A/90

[51] Int. Cl.[5] ..... A43B 5/04; A43B 7/14

[52] U.S. Cl. ..... 36/117; 36/88; 36/93

[58] Field of Search ..... 36/117, 118, 119, 120, 36/121, 88, 87, 93

[56] References Cited

U.S. PATENT DOCUMENTS

| | | | |
|---|---|---|---|
| 3,896,202 | 7/1975 | Palau | 36/117 |
| 4,182,056 | 1/1980 | Dalebout | 36/117 |
| 4,301,564 | 11/1981 | Dalebout | 36/117 |
| 4,414,762 | 11/1983 | Salomon et al. | 36/117 |
| 4,428,089 | 1/1984 | Dawber | 36/93 |
| 4,910,889 | 3/1990 | Bonaventure et al. | 36/117 |
| 5,042,100 | 8/1991 | Bar et al. | 12/142 N |
| 5,095,570 | 3/1992 | Bar et al. | 12/142 N |

FOREIGN PATENT DOCUMENTS

| | | | |
|---|---|---|---|
| 0004829 | 10/1979 | European Pat. Off. | 36/117 |
| 2716998 | 11/1977 | Fed. Rep. of Germany . | |
| 2460118 | 2/1981 | France | 36/117 |

*Primary Examiner*—Jimmy G. Foster
*Assistant Examiner*—M. D. Patterson
*Attorney, Agent, or Firm*—Guido Modiano; Albert Josif

[57] ABSTRACT

The innerboot, particularly for ski boots, for hockey boots, for skates or for other footgear, which has an improved fit, includes at least one first layer of fabric and at least one second layer of fabric which are mutually coupled; at least one layer is initially placed in vacuum and can subsequently expand or self-expand or dilate with catalysis to the assumed position once it has expanded.

16 Claims, 1 Drawing Sheet

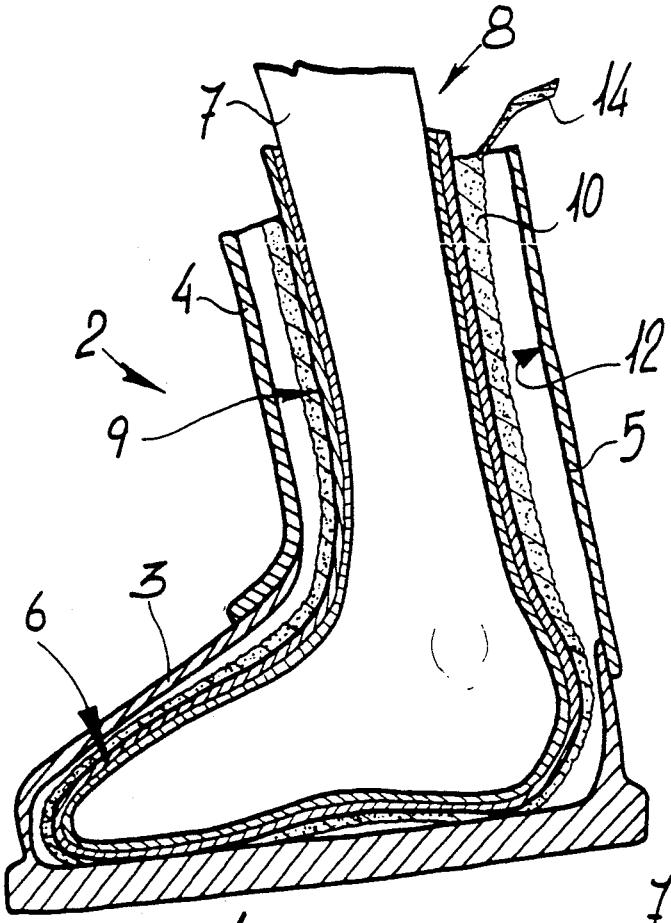
Fig. 1
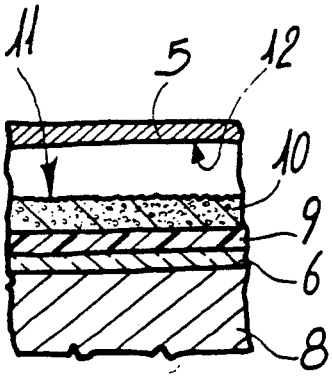
Fig. 3
Fig. 2
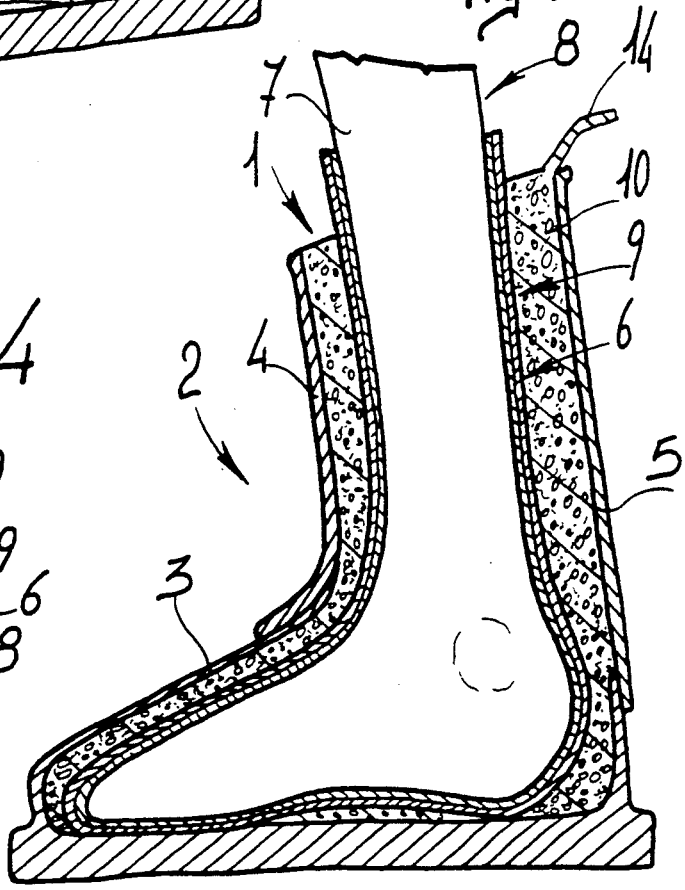
Fig. 4
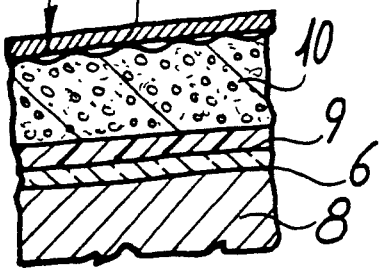

INNERBOOT WITH IMPROVED FIT

BACKGROUND OF THE INVENTION

The present invention relates to an innerboot, such as an innerboot for ski boots, with improved fit.

The provision of the greatest possible comfort for the user is currently strongly felt in the field of footgear and in particular in the field of ski boots.

On this subject, in known boots it is common to use innerboots, the function whereof is to place the skier's foot in contact with soft surfaces and thus not directly in contact with the shell or with the quarters, which are notoriously rigid.

Traction elements or cables are used in known boots; on one hand, when they are tensioned, they create an empty region between the boot and the innerboot, and this does not allow the skier to optimally transmit the effort from the foot to the boot.

On the other hand, said tensioning causes the cable to act in localized regions of the foot, thus not allowing the uniform securing of said foot, and this again leads to a non-optimum transmission of the efforts to the boot.

In order to optimize fit and the skier's comfort, innerboots are known which are internally provided with a cavity inside which material is injected when the boot is closed.

This injection allows to achieve a modeling of the innerboot according to the anatomical configuration of the foot, but at the same time it has been found to have some disadvantages: it has in fact been observed that said injection compresses the foot, especially in particular regions such as that of the plantar arch, making skiing awkward, since the innerboot thus obtained has a non-yielding shape and thus has regions which cannot deform and are therefore not suitable for optimally following the various positions assumed by the foot while practicing the sport.

So-called "flow-fit" innerboots are also known which contain, inside them, a particular putty which, under the pressure of the foot, migrates inside the innerboot which thereby assumes an internal configuration equal to that of the foot inserted therein.

However, even this solution has disadvantages, since it has been observed that in the course of time said putty contained within the innerboot tends to pack, thus lacking in one or more regions and thus cancelling out any possible region of comfort.

It has been furthermore observed that an excess amount of putty inserted in the innerboot entails an excessive overall compression of the foot, and vice versa a limitation of the amount of putty allows the foot to "wobble" inside the innerboot.

Finally, it has been observed that the considerable stresses imparted by the foot while practicing the sport constantly move around the putty placed inside the innerboot, and this places one or more regions of the foot in contact with the shell.

Ski boots are also known which comprise air bags which are arranged between the boot and the innerboot and are inflated directly by the skier.

The disadvantage of said air bags is that they require, for correct use, to be inflated at high pressure, and this entails the subjection of localized regions of the foot to pressures which limit blood circulation like a tourniquet and thus lead to the forming of aches and to lack of sensitivity of the foot while practicing the sport.

The compressibility of the air further allows the foot, in some regions, to touch the boot while practicing the sport.

SUMMARY OF THE INVENTION

The aim of the present invention is therefore to eliminate the disadvantages described above in known types by providing an innerboot, and in particular an innerboot for ski boots, which has an optimum fit and comfort for the skier, both with the boot closed and with the boot open.

Within the scope of the above aim, an important object is to provide an innerboot which allows the skier to maintain the same degree of comfort during the various phases of the practice of the sport.

Another important object is to provide an innerboot which associates with the preceding characteristics that of being customizable according to the specific anatomical requirements of each skier.

Another important object is to provide an innerboot which associates with the preceding characteristics that of securing the foot without producing sores, leaving instead the foot completely free to move for walking if the boot is open.

Another important object is to provide an innerboot which is constructively and structurally simple as well as easy to employ and use on the part of the user.

Not least object is to provide an innerboot which associates with the preceding characteristics that of being reliable and safe in use as well as simple to manufacture.

This aim, these objects and others which will become apparent hereinafter are achieved by an innerboot with improved fit, characterized in that it is constituted by at least one first layer of fabric coupled to at least one second layer of fabric, at least one of said first or second fabric layers being initially placed in a vacuum or under pressure, said layer subsequently expanding or self-expanding or dilating with catalysis to the assumed position.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein:

FIG. 1 is a sectional elevation view of a preferred embodiment of the inner shoe according to the present invention used in a rear-entry ski boot with the quarters partially open, in a condition prior to the catalysis step;

FIG. 2 is a sectional elevation view of the inner shoe and boot as shown in FIG. 1 but in condition following the catalysis step;

FIG. 3 is a sectional view, taken along a longitudinal plane, of the various components of the inner shoe in the condition prior to the catalysis condition;

FIG. 4 is a view, similar to the preceding one, of the condition in which catalysis has been obtained.

DESCRIPTION OF THE PREFERRED EMBODIMENTS

With reference to the above figures, an innerboot is shown, indicated by the reference numeral 1, particularly for a ski boot 2 constituted by a shell 3 with which a front quarter 4 and a rear quarter 5 are associated.

Alternatively, the innerboot can be used in other types of boots or can be arranged inside other different types of footgear.

The innerboot 1 is constituted by an inner lining, indicated by the numeral 6, which is made of a material which makes direct contact with the skin 7 of the leg 8 of the skier; said first layer is constituted, for example, by material known as non-woven fabric.

More precisely, said inner lining 6 completely embraces the skier's foot and partially embraces the tibia, and is 5 provided, possibly in a rearward position, with an opening for inserting the foot inside it.

A first layer of material, generally indicated by the reference numeral 9, is connected to the inner lining 6, preferably by glueing. Such first layer 9 is made of fabric or is elastically deformable and is thus advantageously constituted by closed-cell sponge or rubber.

A second layer of material, indicated by the numeral 10, is coupled, preferably by glueing, to said first layer and is advantageously constituted by open-cell sponge or rubber or by material prepared beforehand with hollow regions and suitable for being placed in vacuum or for being pressurized.

Said second layer can be impregnated with catalyst material and can be contained within an appropriate bag or other containment element for obtaining a vacuum.

In a preferred embodiment, the second layer 10 is constituted by a sack whose inside is filled with a polyurethane foam (or equivalent material with open cells) which is impregnated, in advance, with catalyst material constituted for example by a polyurethane resin that reacts with water. The sack is then put under vacuum, for example in a vacuum chamber, which thus saturates the polyurethane foam with liquid polyurethane resin and hermetically contains it (thereby under vacuum) in a sack, advantageously constituted by two aluminum sheets (or material which is impermeable to water). During this phase, one or more valves for the eventual addition of humid air or water is inserted in the sack.

This solution is illustrated in FIG. 1.

It is specified that it is possible for the manufacturer to vary the density of the first and/or second layers and the expandable volume of the second layer in one or more regions, according to the specific points or regions of the foot where a greater effort is required during the practice of the sport.

During the production of the second layer 10 it is thus possible to provide different dosages in order to provide a greater or smaller expansion of said layer.

The second layer of material 10 has the peculiarity of being expandable or dilatable, since it is for example constituted by a vacuum-compacted open-cell material or sponge impregnated with a catalyst.

During the execution of the innerboot, the second layer 10 has a vacuum tightness valve, indicated by the numeral 14, which is constituted by a tab which protrudes from one of the quarters of the boot and can be opened by the skier.

To use the invention, the skier must initially put the innerboot on and then put said innerboot in the boot, appropriately tightening said boot, preferably with an intermediate tightness.

In this step the skier assumes the position assumed during the practice of the sport, and then opens the valve 14; in this manner air, possibly mixed with another catalyzing liquid or gas, enters the second layer.

At this stage the material contained in the second layer expands or dilates until it fills the empty spaces between the first layer and the shell or the quarters of the boot.

One thus achieves the condition illustrated in figures 2 and 4, wherein, without varying the dimensions of the first layer of material 9, the innerboot 1 adapts, not to the foot 8 of the skier, but to the inner configuration of the boot and thus to that of the front quarter 4, of the rear quarter 5 and of the shell 3.

Conveniently, the surface 11 of the second layer of material 10 which faces the inner surface 12 of the front quarter 4, of the rear quarter 5 and of the shell 3 can have an intentional discontinuity which determines, once it has expanded, cavities 13 between said surfaces 11 and 12.

This allows to further increase the condition of comfort for the skier.

Another characteristic of the second layer of material 10 is that it catalyzes, after a preset time. and permanently sets the assumed configuration; this allows to achieve an optimum feeling of comfort both in the skier's resting condition and in the condition of non-use of the boot, by virtue of the deformability of said second layer of material 10.

Alternatively, the expansion or dilation of the second layer of material 10 can occur by means of a chemical or thermal reaction, said second layer being for example internally made of open-cell rubber arranged within a bag which is in turn in vacuum and is subsequently opened with the consequent catalysis of said layer.

Conveniently, the second layer of material 10 may not fully affect the first layer of material 9, and there may therefore be one or more limited regions at which expansion does not occur or occurs partially; this may be for example the case of one or more portions of the plantar arch, where any pressure exerted thereon is unpleasant, due to the deformation which it undergoes during the practice of the sport upon a variation of the efforts imparted to the foot.

It has thus been observed that the invention has achieved the intended aim and objects, an innerboot for ski boots having been obtained which allows, once the second layer of material has expanded and catalyzed, to achieve an optimum comfort for the skier during all the steps of skiing, and even if the boot is opened in order to walk.

The invention is naturally susceptible to numerous modifications and variations, all of which are within the scope of the same inventive concept.

Thus, for example, it is possible to have a plurality of layers arranged in various sequences with respect to one another.

As a further example, the fact is mentioned that the second layer of material 10 might expand not toward the inner surface of the front quarter, of the rear quarter or of the shell, but toward the skier's foot: in this case, the skier naturally must take care to wear a sock so that the second layer of material 10 does not make direct contact with the skin.

As a further embodiment, the inner shoe according to the present invention can comprise two first layers between which a second expandable or dilatable layer is interposed.

It is furthermore noted that the combination of the first layer 9 with expandable second layer 10 coupled thereto has also been found to be extremely adaptable in use with helmets, bicycle seats, armchairs and couches, car seats and isolation panels.

The materials employed may naturally be the most pertinent according to the specific requirements.

I claim:

1. Inner shoe particularly for ski boots comprising an inner lining, a first layer of elastically deformable material connected to said inner lining, a second layer bonded to a surface of said first layer, said second layer comprising a hermetically sealed sack connected to said first layer, a vacuum-compacted open-cell material contained within said hermetically sealed sack, said vacuum-compacted open-cell material being saturated with a catalyst, valve means provided in said hermetically sealed sack for introducing therein a fluid which reacts with said catalyst, whereby to permit expansion of said second layer while wearing said inner boot with anatomical adaptation of said inner shoe to the shape of a wearer's foot.

2. Inner shoe according to claim 1, wherein said inner lining is made of non-woven fabric, and wherein said first layer of elastically deformable material is glued to said inner lining.

3. Inner shoe according to claim 1, wherein said first layer of elastically deformable material is made of closed-cell sponge.

4. Inner shoe according to claim 1, wherein said first layer of elastically deformable material is made of rubber.

5. Inner shoe according to claim 1, wherein said hermetically sealed sack is made of aluminium.

6. Inner shoe according to claim 1, wherein said vacuum-compacted open-cell material of said second layer comprises polyurethane foam, and wherein said catalyst comprises liquid polyurethane resin.

7. Inner shoe according to claim 1, wherein said catalyst comprises a water-reacting catalyst, and wherein said valve means are provided for introducing water-containing fluid into said sack for reaction with said water-reacting catalyst.

8. Inner shoe according to claim 7, wherein said water-containing fluid comprises humid air.

9. Inner shoe particularly for ski boots comprising an inner lining, a first layer of elastically deformable material glued to said inner lining, a second layer of connected to said first layer, said second layer comprising a hermetically sealed metallic sack glued to said first layer, a vacuum-compacted open-cell material contained within said hermetically sealed metallic sack, said vacuum-compacted open-cell material being saturated with a catalyst, valve means provided in said hermetically sealed metallic sack for introducing a fluid therein which reacts with said catalyst, whereby to permit expansion of said second layer while wearing said inner boot, with anatomical adaptation of said inner shoe to the shape of a wearer's foot.

10. Inner shoe according to claim 9, wherein said inner lining is made of non-woven fabric, wherein said first layer is made of an elastically deformable material selected from a group of materials consisting of closed-cell sponge and rubber, and wherein said hermetically sealed sack is made of aluminium.

11. Inner shoe according to claim 1, wherein said vacuum-compacted open-cell material comprises polyurethane foam, wherein said catalyst comprises liquid polyurethane resin, and wherein said valve means are provided for introducing water-containing fluid into said sack for reaction with said liquid polyurethane resin.

12. Inner shoe particularly for ski boots comprising;

an inner lining made of non-woven fabric;

a first layer of elastically deformable material glued to said inner lining, said first layer being made of an elastically deformable material selected from a group of materials consisting of closed-cell sponge and rubber;

a second layer connected to said first layer and comprising;

a hermetically sealed metallic sack glued to said first layer;

a vacuum-compacted open-cell polyurethane foam material contained within said hermetically sealed metallic sack; a liquid polyurethane resin catalyst saturating said vacuum-compacted open-cell polyurethane foam material, and;

valve means provided in said hermetically sealed metallic sack for introducing therein, water-containing fluid for reaction with said liquid polyurethane resin catalyst, whereby to permit expansion of said second layer while wearing said inner boot with anatomical adaptation of said inner shoe to the shape of a wearer's foot.

13. Inner shoe according to claim 12, wherein said hermetically sealed metallic sack is made of aluminium.

14. In combination, a ski boot and an inner shoe contained in said ski boot, said ski boot comprising;

a shell, a rear quarter connected to said shell, and a front quarter connected to said shell, said inner shoe comprising;

an inner lining;

a first layer of elastically deformable material glued to said inner lining;

a second layer connected to said first layer, said second layer comprising;

a hermetically sealed metallic sack glued to said first layer of elastically deformable material;

a vacuum-compacted open-cell material contained within said hermetically sealed metallic sack;

a catalyst saturating said vacuum-compacted open-cell material, and;

valve means provided in said hermetically sealed metallic sack for introducing a fluid therein which reacts with said catalyst, whereby to permit expansion of said second layer for filling any spaces existing between said inner lining and said shell, said front quarter and said rear quarter while wearing said inner boot, with anatomical adaptation of said inner shoe to the shape of a wearer's foot.

15. Combination according to claim 14, wherein said inner lining is made of non-woven fabric, wherein said first elastically deformable layer is made of a material selected from a group of materials consisting of closed-cell sponge and rubber, and wherein said hermetically sealed sack is made of aluminium.

16. Combination according to claim 14, wherein said vacuum-compacted open-cell material comprises polyurethane foam, wherein said catalyst comprises liquid polyurethane resin, and wherein said valve means are provided for introducing water-containing fluid into said sack for reaction with said liquid polyurethane resin.

* * * * *